United States Patent [19]

Boucher et al.

[11] 4,138,096

[45] Feb. 6, 1979

[54] COMBINED CRUCIBLE, TUNDISH AND POURING SPOUT

[75] Inventors: Raymond R. Boucher, Tequesta; Robert A. Metcalfe, West Palm Beach, both of Fla.

[73] Assignee: United Technologies Corporation, Hartford, Conn.

[21] Appl. No.: 865,085

[22] Filed: Dec. 27, 1977

[51] Int. Cl.[2] ..... F27B 14/02

[52] U.S. Cl. ..... 266/240; 266/242

[58] Field of Search ..... 266/236, 240, 242; 432/167, 263

[56] References Cited

U.S. PATENT DOCUMENTS

| | | | |
|---|---|---|---|
| 1,883,755 | 10/1932 | Begtrup | 432/263 |
| 1,940,619 | 12/1933 | Barstow et al. | 266/240 |
| 3,350,083 | 10/1967 | Buhrer et al. | 266/240 |
| 3,450,823 | 6/1969 | Willan | 266/236 |
| 4,043,543 | 8/1977 | Courtenay et al. | 266/236 |

*Primary Examiner*—Gerald A. Dost

*Attorney, Agent, or Firm*—Jack N. McCarthy

[57] ABSTRACT

A crucible, tundish, and pouring spout is formed as a single unit with the crucible portion being positioned in an induction furnace for providing sufficient heat to ingots placed in the crucible portion. An extension is positioned on top of the crucible portion on one side forming an integral tundish portion with one part of the crucible for the molten metal. After the induction coil had melted the ingot and the induction heater and crucible portion are tilted approximately 90°, the molten metal is held by the tundish portion. A pouring spout portion extends from the extension referred to for pouring the molten metal from the tundish portion. Said pouring spout portion includes a nozzle insert and intermediate insert for providing the proper restricted opening and to protect the inner sides of the spout portion. A metal plug is provided where the spout portion meets the tundish portion which is melted by the molten metal to start the pouring at a predetermined time after the induction heater and crucible portion have been rotated. A heat shield is provided over the opening of the crucible portion and tundish portion for preventing unnecessary exposure of the interior thereof.

1 Claim, 4 Drawing Figures

FIG. 1
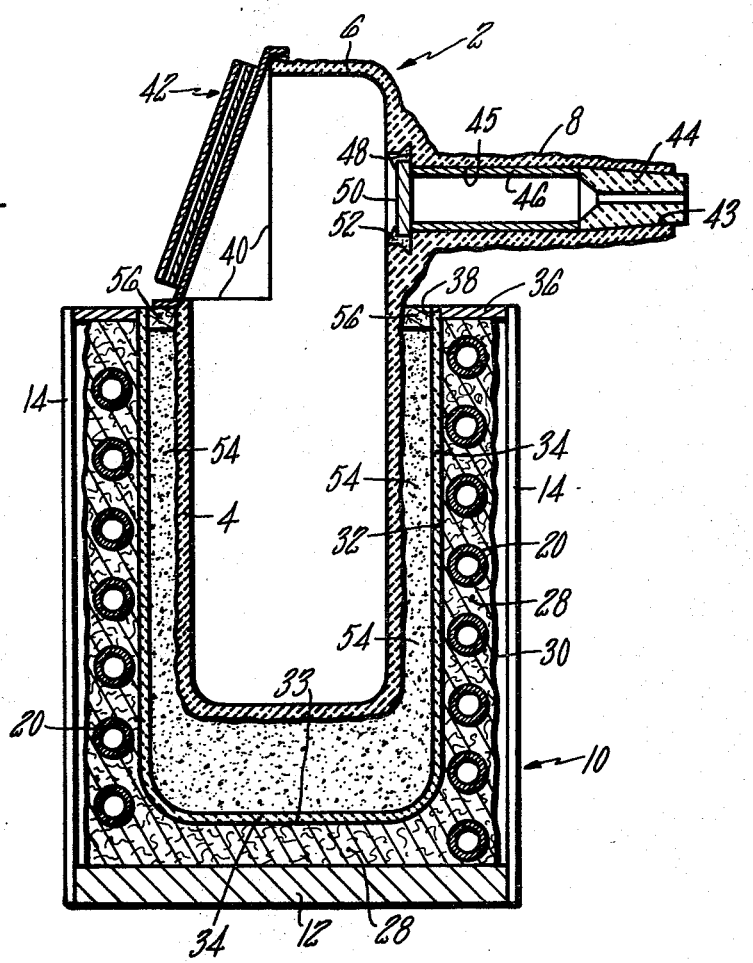
FIG. 2
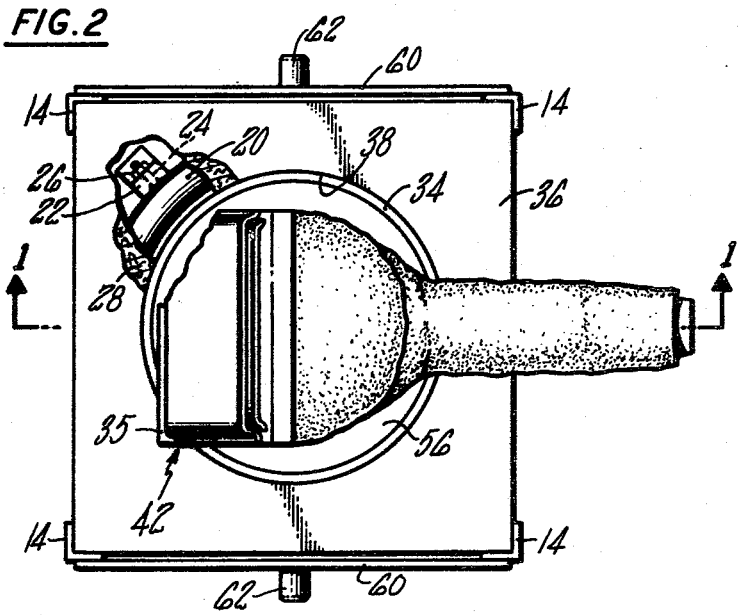
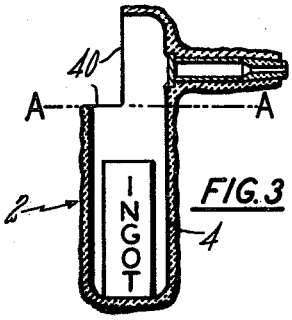
FIG. 3
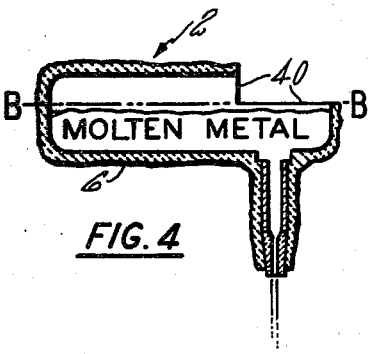
FIG. 4

COMBINED CRUCIBLE, TUNDISH AND POURING SPOUT

BACKGROUND OF THE INVENTION

This invention relates to a device which incorporates a crucible, tundish, and pouring spout in a single unit. Examples of the prior art showing melting pots, melting furnaces, and a crucible, are set forth below: U.S. Pat. Nos. 175,081; 1,883,755; 2,650,255; and 3,790,338.

SUMMARY OF THE INVENTION

According to the present invention, an apparatus is set forth having a device which is a combined crucible, tundish, and pouring spout wherein metal can be placed in a molten state in a crucible portion, tilted to a position where the molten metal is in a tundish portion, and then directed from a spout portion after a predetermined period of time, determined by a melt plug.

It is an object of this invention to provide a combined crucible, tundish, and pouring spout device in which a single heat source melts the metal "charge" in a crucible portion and preheats the tundish portion.

It is another object of this invention to provide a combined crucible, tundish, and pouring spout device having a heat shield located over a top opening therein which remains in place throughout the heating of the metal in the crucible portion and the transfer of the molten metal to the tundish portion.

It is a further object of this invention to provide a combined crucible, tundish, and pouring spout device having delayed pouring from the spout portion after the molten metal has been placed in the tundish portion from the crucible portion. This eliminates "molten stream wander" due to open external pouring. The tundish portion is hot and a stable head of molten metal is established during the time required to melt out the pouring plug.

It is another object of this invention to provide a crucible portion which can be fixed in an induction heater at a slight angle, feeding molten metal to the tundish portion to maintain a constant pressure head throughout most of the pouring cycle.

It is a further object of this invention to provide a combined crucible, tundish, and pouring spout device wherein the device can be placed back to a vertical position and this action will immediately stop the pour.

BRIEF DESCRIPTION OF THE DRAWINGS

FIG. 1 is a view taken along the line 1—1 of FIG. 2 showing the combined crucible, tundish, and pouring spout device fixedly mounted in a conventional induction furnace in a vertical position;

FIG. 2 is a top view with a portion broken away of the combined crucible, tundish, and pouring spout device fixedly mounted in a conventional induction furnace;

FIG. 3 shows the combined crucible, tundish, and pouring spout device with an ingot placed in the crucible portion prior to melting; and FIG. 4 shows the combined crucible, tundish, and pouring spout device in a horizontal position where it has been tilted to permit the molten metal to be contained by the tundish portion and flow from the spout portion.

DESCRIPTION OF THE PREFERRED EMBODIMENT

FIG. 1 shows a combined crucible, tundish, and pouring spout device 2 comprising (1) a crucible portion 4 which contains the metal in solid form in its vertical position prior to melting with the metal placed in the crucible 4 usually in chunk form with the chunks being called ingots; (2) a tundish portion 6 which contains the metal in liquid form in its horizontal position prior to pouring; and (3) a spout portion 8 which permits the metal in liquid form to pour from said combined crucible, tundish, and pouring spout device 2. Parts of the crucible portion 4 and tundish portion 6 are the same, depending on the position of the combined crucible, tundish, and pouring spout device 2. As shown in FIG. 3, the crucible portion 4 is located below the line A—A and in FIG. 4 the tundish portion 6 is located below the line B—B. The spout portion 8 extends from the part of the tundish portion 6 which is located above the line A—A.

The crucible portion 4 of the combined crucible, tundish, and pouring spout device 2, as has been mentioned before, has its top located at the line A—A, and the tundish portion 6 has its top located at the line B—B. This construction provides an opening 40 at the top left portion of the combined crucible, tundish, and pouring spout device as shown in the vertical position in FIG. 3, and the top right portion of the combined crucible, tundish, and pouring spout device as shown in the horizontal position shown in FIG. 4. This opening 40 can be used for placing ingots in the crucible. A heat shield 42 is mounted at two locations 35 to the top plate 36, for example by screws, for removal when desired. Any type attach-detach device desired can be used. The heat shield 42 can be hinged to the top plate 36, if desired. This heat shield 42 prevents unnecessary exposure of the melt to higher radiation losses. The heat shield 42 is angled to reflect heat directly on the tundish portion 6 containing the spout portion 8.

The spout portion 8 of the combined crucible, tundish, and pouring spout device 2 extends downwardly from the tundish portion 6 of the combined crucible, tundish, and pouring spout device 2 for performing its function as a spout. The spout extends outwardly from a point opposite the opening 40 and has an internal surface 43 which is tapered inwardly at the bottom to receive a removable nozzle insert 44. The middle portion of the spout has a cylindrical surface 45 and has a removable liner 46 placed therein. The top of the cylindrical surface stops at the center of a recess 48 in the wall of the combined crucible, tundish, and pouring spout device 2. The nozzle insert 44 and the liner 46 can be formed of a metal or ceramic with the replaceable nozzle insert 44 providing for a change in the nozzle opening. Prior to operation of the device, a metal pouring plug 50 of predetermined thickness is placed in the recess 48 and held in by ceramic cement 52. The metal pouring plug 50 is formed of a material which is compatible with the molten metal in the tundish 6 and the predetermined thickness of the metal pouring plug 50 determines the time required for the molten metal in the tundish 6 to melt the plug and start flowing from the spout portion 8. In a device constructed, the body of the combined crucible, tundish, and pouring spout device 2 was made as a one-piece ceramic body made of alumina.

To provide for heating the ingot, the combined crucible, tundish, and pouring spout device 2 is fixed in an induction furnace 10. This conventional induction furnace 10 comprises an outer framework consisting of a bottom plate 12 and angled end pieces 14 fixed to the corners thereof and extending upwardly to provide the necessary support. An induction coil 20 is positioned around the outer part of the bottom plate 12. The induction coil is mounted to upstanding members 22, of conventional material, extending upwardly from each corner of the bottom plate 12. Bolts 24 project from the outer portion of the induction coil 20 and as it coils upwardly, the bolts are placed to extend through openings in the upstanding members 22 and are held by nuts 26.

The induction coil 20 is encased with an air setting refractory cement 28 having a rough-finished external surface 30 and a smooth cylindrical internal surface 32; the air setting refractory cement 28 also covers the bottom plate 12 at the bottom coil of the induction coil 20, providing a smooth surface 33 at the bottom. The smooth internal surface of the cylindrical opening and bottom can be covered by a protective asbestos liner 34 for a purpose to be hereinafter disclosed. A top plate 36 is fixed to the top ends of the angled pieces 14. The top of the asbestos liner 34 extends into an opening 38 in the center of the top plate 36. The induction coil 20 includes conventional connections to a generator (not shown).

The combined crucible, tundish, and pouring spout device 2 is placed with the crucible portion 4 extending into and spaced from the side and bottom of the opening formed by the asbestos liner 34. A dry refractory material 54 is placed between the outer surface of the crucible 6 and the asbestos liner 34 and rammed to provide a tight pack fixing the crucible portion 4 in place. To prevent the dry refractory material from becoming loose, a top coating of an air setting refractory cement 56 is placed around the top of the dry rammed refractory material 54. The asbestos liner 34 prevents the dry refractory material from leaking out of any crack formed in the air setting refractory cement 28.

So that the combined crucible, tundish, and pouring spout device 2 can be moved between its position in FIG. 3 and its position in FIG. 4, a metal cross member 60 is placed on each side between the angled end pieces 14 having trunions 62 extending therefrom. These trunions can be placed in any conventional yoke mechanism to permit the induction furnace 10 and combined crucible, tundish, and pouring spout device 2 to be tilted.

We claim:

1. A combined crucible, tundish, and pouring spout device comprising a crucible of cup-like shape having an integral extension on one side on the top thereof, said extension forming a tundish with the one side of said cup-like shape when said crucible is rotated approximately 90° with that one side positioned downwardly, a tubular spout extending at an angle of 90° from the closed side of said extension, and plug means in said tubular spout for blocking said spout, said plug means being constructed of a material which can be melted by contact with molten metal, said crucible and tundish have an opening on the other side of the top of the crucible of cup-like shape from said extension and over said extension, a heat shield means positioned over said opening for reflecting heat on an exposed part of said tundish and said spout, said heat shield means comprising a heat shield extending from the top of the crucible of cup-like shape located opposite the spout to the top of said extension, said heat shield means being spaced from said opening and not providing a closed cover.

* * * * *